US005160109A

United States Patent [19]

de Leeuw

[11] Patent Number: 5,160,109

[45] Date of Patent: Nov. 3, 1992

[54] STEEL POST SHORE, OR PROP, FOR SUPPORTING OF FORMWORK IN CONSTRUCTING BUILDINGS

[76] Inventor: Petrus J. L. de Leeuw, B. van Heesselstraat 5, 5735 AK Aarle-Rixtel, Netherlands

[21] Appl. No.: 675,137

[22] Filed: Mar. 26, 1991

[30] Foreign Application Priority Data

Mar. 26, 1990 [NL] Netherlands ..... 9000711

[51] Int. Cl.[5] ..... A47F 5/00

[52] U.S. Cl. ..... 248/354.4; 254/98; 403/378

[58] Field of Search ..... 248/354.4, 188.2, 354.3; 403/107, 378, 379; 254/9, 13, 98

[56] References Cited

U.S. PATENT DOCUMENTS

| | | | |
|---|---|---|---|
| 3,520,224 | 7/1970 | Hensley | 403/379 X |
| 3,870,268 | 3/1975 | Larkin | 248/354.4 X |
| 3,884,589 | 5/1975 | Liedholm | 403/378 X |
| 4,221,363 | 9/1980 | Jasper | 254/98 |

FOREIGN PATENT DOCUMENTS

| | | | |
|---|---|---|---|
| 574824 | 4/1933 | Fed. Rep. of Germany | 248/354.4 |
| 3739754 | 6/1987 | Fed. Rep. of Germany . | |
| 3613075 | 7/1987 | Fed. Rep. of Germany . | |
| 3727780 | 3/1989 | Fed. Rep. of Germany . | |
| 1406027 | 6/1965 | France . | |
| 1190270 | 4/1970 | United Kingdom | 248/354.4 |

*Primary Examiner*—J. Franklin Foss
*Attorney, Agent, or Firm*—Fiddler & Levine

[57] ABSTRACT

For supporting of formwork in constructing buildings, use is made of steel post shores (props) having a pin with recessed areas thereon. When the prop has to be brought from the loaded to the unloaded position, such pin is changed of position in the prop so as to allow the inner tube to be lowered within the outer tube of the prop. The invention provides a new pin-design such that after assembling the prop it can be clearly seen whether the pin finds itself in the correct position or not. For that purpose, use is made of a pin having a recess and a flattened portion; by axial displacement of the pin this portion rests on a ring or on an inner tube under changing its angular position, which is well visible for the user. Alternatively a cylindrical pin may have two cams resting on a ring; by axially displacing this pin it will rotate over 90° and the inner tube will be lowered in the outer tube, which position is clearly visible for the user.

5 Claims, 4 Drawing Sheets

STEEL POST SHORE, OR PROP, FOR SUPPORTING OF FORMWORK IN CONSTRUCTING BUILDINGS

Figure 1:
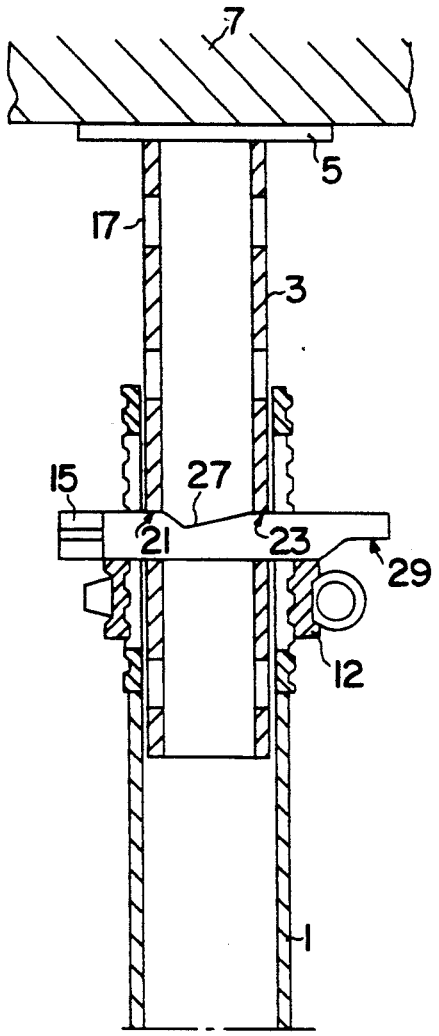

The invention relates to a construction system, generally having a steel post shore, or prop, for supporting of formwork, deckings or the like in constructing buildings, which has two telescopically movable tubes, in which the outer tube—at the end of which the inner tube is inserted—is provided with a threaded portion and in which holes are arranged in a longitudional row along the inner tube, in which a pin in a direction, transverse to the longitudinal direction of the tube can be passed and can be moved therein in its longitudinal direction, which pin can be supported on a socket or ring being screwed onto the outer side of the outer tube, the pin, at its circumference being such provided with recesses that at its displacement in its longitudinal direction the supporting inner tube can be inserted over a distance into the outer tube. Such a steel post shore is known from DE-PS 3613075 and is applied to support for instance formwork for a concrete deck. It is devised so as to allow, after the concrete deck has been established, the telescopically arranged inner tube quickly to be lowered into the outer tube over some distance, so that this loaded inner tube and the ring can be released. By screwing thereafter the ring, a further displacement of the inner tube into the outer tube can be archieved, so that the total steel post shore can be easily removed.

In this quick release, use can be made of a slidable cylindrical pin, in the upper surface of which two transverse grooves are present, in which the inner tube in one of the displaced pin positions is carried by the cylindrical portion of the pin and in the other displaced pin position this tube is carried in the said grooves in the cylindrical upper surface of the pin. By a stroke of a hammer the pin is axially displaced from the strongly loaded working position to its practically unloaded position.

The known construction has several disadvantages. Firstly it is not or unsufficiently visible in which of the two positions the pin finds itself, which can lead to confusion during quickly mounting of many steel post shores. If the pin is mounted in its lowered position or during mounting of the shore is held in this position, this cannot or with great difficulties only, afterwards be brought to its working position, under the load of a decking.

Moreover, to ensure quickly lowering of the inner tube over a reasonable distance , use must be made of relatively deep grooves in the upper surface of the pin, which gives rise to a weakening of the pin being subjected itself already to considerable bending moments.

Furthermore it is necessary with the known construction to block the cylindrical pin against a rotation around its axis so as to keep the grooves in a horizontal position. This requires a solid brace of a special construction being attached at the end of the pin and arranged in a loop around the prop. During a rough use of the props these braces can easily be deformed, whereby their action fails.

The invention has for its purpose to indicate with several embodiments a construction not having the aforementioned disadvantages.

The steel post shore according to the invention is characterised, in that after the displacement of the pin from the fully loaded position of the prop to a nearly unloaded position of said prop, this pin takes up a position, in which in relation to the horizontal it is arranged obliquely, or a position in which it is fallen over around its longitudinal axis.

By providing at the upper surface of the pin at best one recessed supporting surface for supporting the inner tube and providing another shape at the end portion of the pin which supports the ring, it is possible to bring the pin in its oblique angular position relative to the horizontal or to bring the pin in a position where it has been rotated around its longitudinal axis, thereby releasing the prop.

A first main embodiment based on the afore mentioned principle is characterised, in that the pin at its upwardly directed preferably cylindrical surface has a preferably curved recess into which during the horizontal displacement of the pin the inner tube can drop, this pin at its lower end directed to the socket or ring furthermore having a flattened portion at a distance from said recess larger than the diameter of the inner tube, which flattening portion during the horizontal displacement of the pin to its oblique position can be lowered on the ring. In this embodiment the released pin thus will take up a clearly visible angular position A second main embodiment based on the aforementioned principle is characterised , in that the pin has a preferably cylindrical shape, having at both ends cams extending transversely from the pin, that the holes in the inner tube have a longitudinal, preferably oval shape, the longitudinal axis of which extends into the longitudinal direction of the tube, and through which holes the pin can be inserted, in which the pin is provided with a locking member cooperating with the upper side of a ring so that the pin with its cams downwardly directed can support the inner tube and by axially moving the pin said locking member comes free from the ring and the pin falls over 90 degrees around its longitudinal axis, in which the cams with a side-surface thereof bears on the ring and the side-surface of the cylindrical portion of the pin takes up a lowered position and supports the lowered inner tube. In the released position the pin has rotated over nearly 90 degrees and finally takes up an angular position. With the prop according to this second main embodiment advantageously use can be made of an inner tube which is provided with a number of preferably oval holes extending in the longitudinal direction of the tube, the longest axis of which extends in the longitudinal direction of the tube. This enables, in cooperation with the pin changing its position, to choose a greater distance along which the inner tube lowers than would be possible with the prior art.

Figure 2:
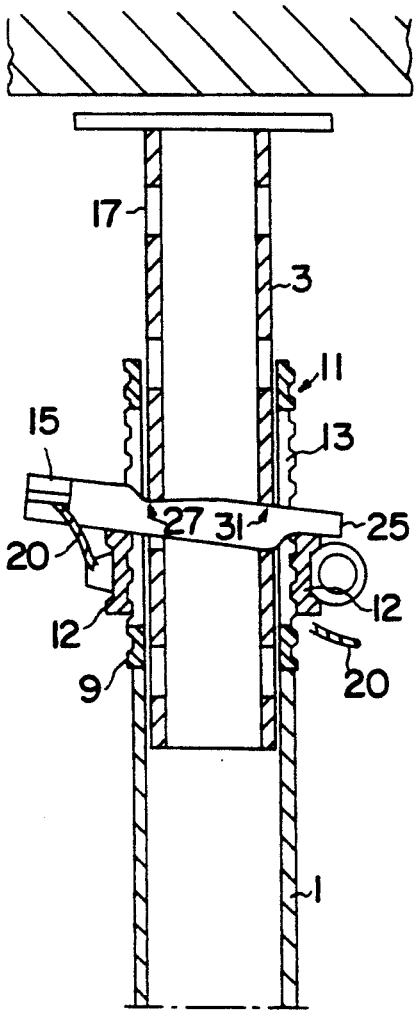
Figure 3:
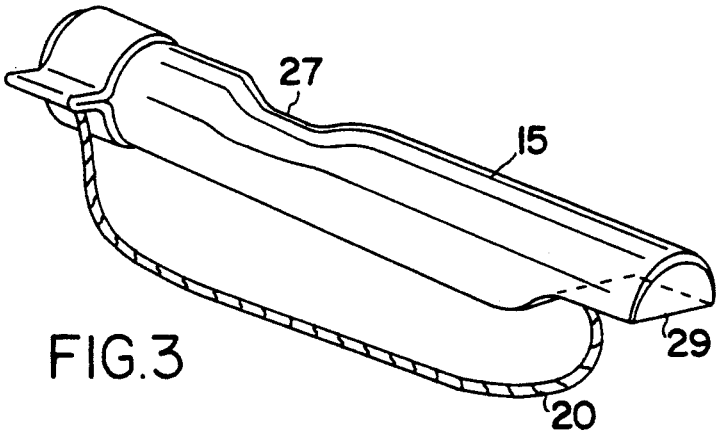
Figure 4:
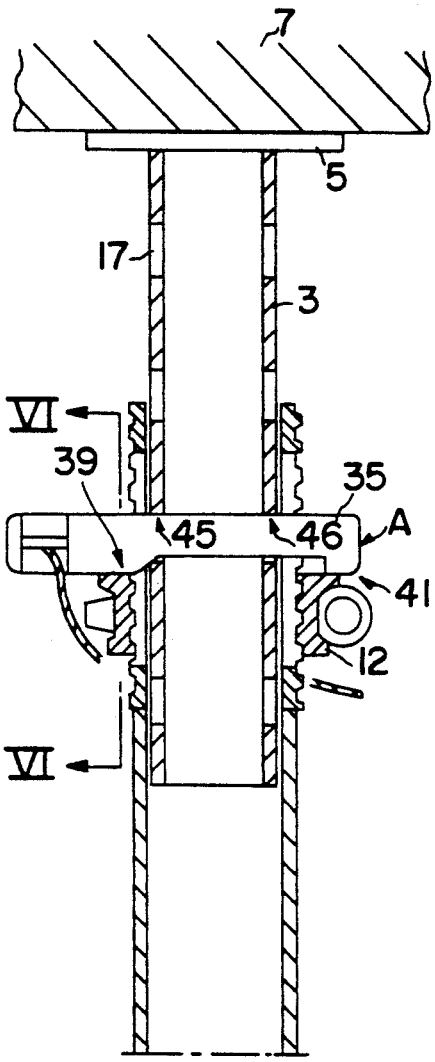
Figure 5:
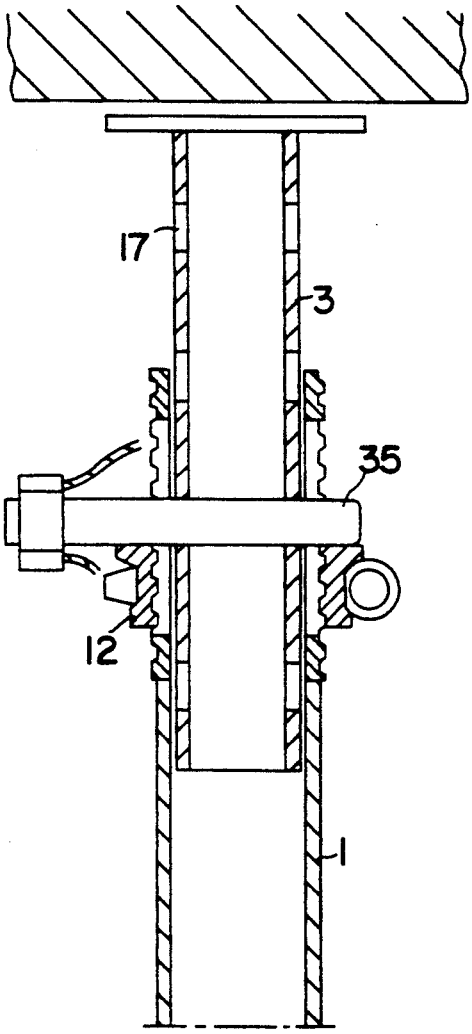
Figure 6:
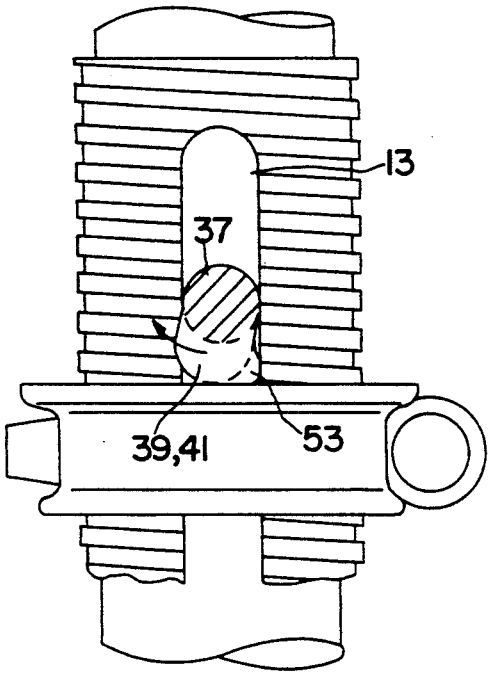
Figure 7:
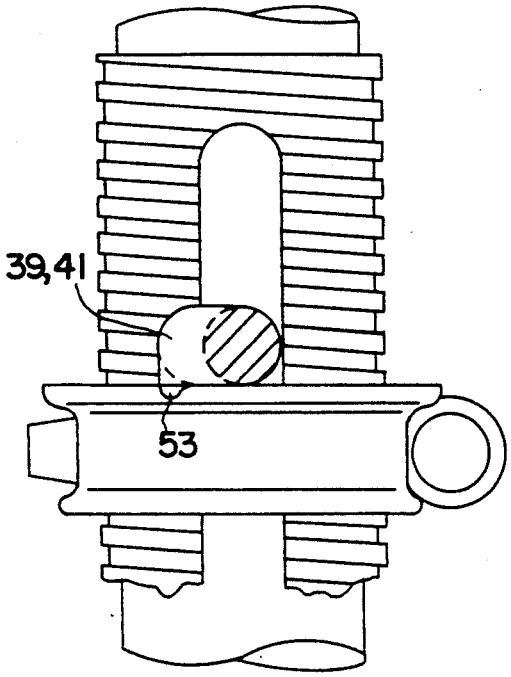
Figure 8:
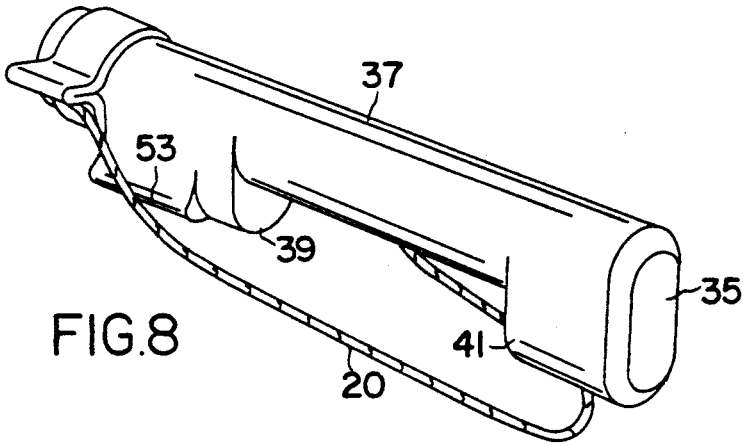
Figure 9:
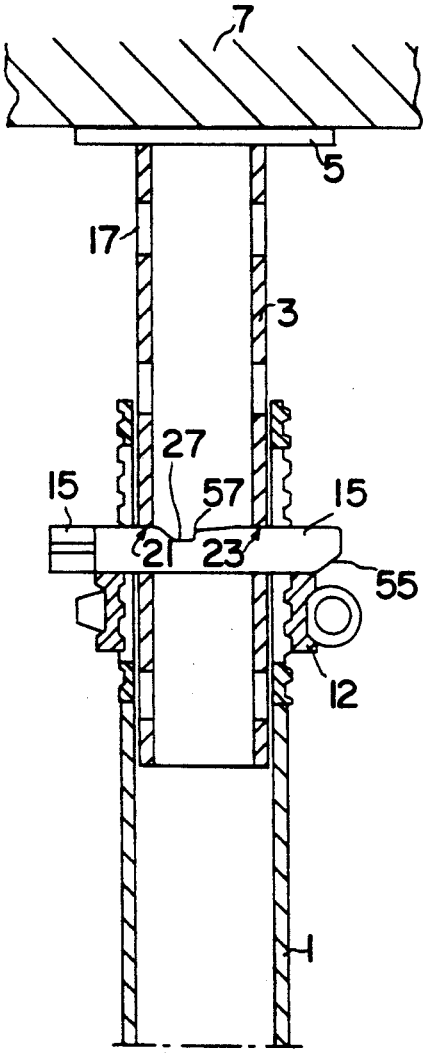
Figure 10:
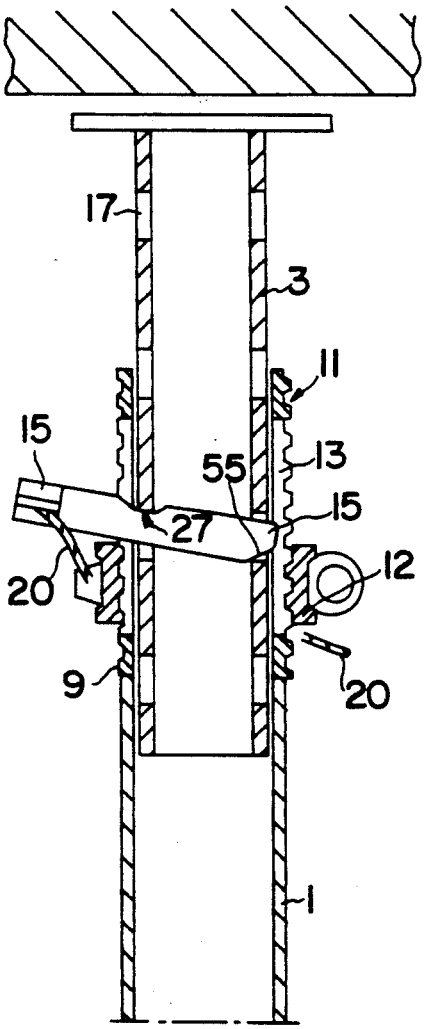

The invention will now be nearer described for some examples of steel post shores on the basis of the drawing, in which:

FIG. 1 is the longitudinal cross section of a steel post shore for supporting deckings or the like, in its working position, FIG. 2 is a similar longitudinal cross section with the inner tube of FIG. 1 in its lowered position, FIG. 3 shows in perspective the pin of FIGS. 1 and 2, FIG. 4 is a longitudinal cross section of a support of a second embodiment with the pin in its working position, FIG. 5 is a similar longitudinal cross section as FIG. 4 with the inner tube in a lowered position, FIG. 6 is a cross section along VI—VI of FIG. 4, FIG. 7 is a similar cross section as FIG. 6 with the pin in a fallen over position, FIG. 8 shows in perspective the pin as used in FIG. 4, 5, 6 and 7, FIG. 9 is a longitudinal cross section of a support showing a third embodiment of the pin, and FIG. 10 is a similar longitudinal cross section as FIG. 9 with the pin in its oblique position after its axial displacement.

In a first embodiment (FIGS. 1, 2) the steel post shore comprises an outer tube 1 and an inner tube 3 axially slidable therein in a telescopic way. The inner tube 3 has a top plate 5 at its upper end supporting formwork 7 for a concrete deck.

The upper end of the outer tube 1 has an extended portion 9 with a threaded part 11 on which a ring or socket 12 has been screwed. Preferably an oblong hole 13 is provided in this extended portion 9. Through this hole a pin 15 is inserted which rests on the upper side of the ring or socket 12.

To enable the mounting of the pin 15 at several levels a number of regularly divided circular of preferably oval holes 17 are provided. The long axis of the oval holes coincides with the axis of the inner tube 3.

The pin 15 itself also shows a circular or oblong, e.g. oval, cross section, and is so deviced that it can be inserted through the hole 17 with some play. A steel wire indicated by 20 is laid around the tube and fixed to the head of the pin so as to ensure that the pin remains connected with the steel post shore.

In establishing the supporting construction the pin is inserted through the slot 13 and one hole 17 so that it takes up the position of FIG. 1. Thereafter the ring 12 is axially displaced by screwing it on portion 11 till the plate 5 finds itself at the desired level. Thereafter the formwork 7 is mounted, into which concrete is applied.

The pen 15, resting on the ring 12, supports the inner tube 3 at its circumferential portions indicated by 21 and 23.

In order to quickly release thereafter the support and to bring it in a condition according to FIG. 2, the pin 15 is moved axially to the left by for example a stroke of a hammer exerted on the end 25 of the pin. The pin 15, being provided in a suitable way with a recess 27 at its upper surface and a flattened part 29 at its lower surface at the end of the pin, will cause during the axial movement to the left the inner tube 3 to drop, wherein the pin 15 will take up an oblique, angular position shown in FIG. 2. Due to the shape of the pin 15, the inner tube 3 rests on the portions 27 and 31 at the upper side of the pin. With its flattened end portion 29, arranged opposite to the portion 31 at the lower surface of the pin, this pin rests on the ring 12. Due to the feature that the pin has a flattened end portion 29 it takes up an end position in which the recess will be constantly directed upwardly. This allows the use of a simple, flexible steelwire 20 to ensure that the pin remains connected to the steel port shore. In the released position of the steel post shore the ring 11 can be screwed downwardly and the whole construction can be removed.

In a second embodiment, related to FIGS. 9 and 10, the shape of the pin is somewhat changed. At its end this pin has a beveled portion 55. When the pin (FIG. 9) is moved to the left, this end portion 55 will rest on the inner tube 3. In this oblique position the upper surface of the pin 15 supports with one area 27 only the inner tube 3. This construction enables to choose, if desired so, a position of the pin, the angle of which to the horizontal can even be larger than in the support of FIG. 1. To ensure that during the movement of the pin 15 to the left this pin will not leave the inner tube 3, the pin 15 is further provided with an abutment rim 57.

In a third embodiment (FIGS. 4, 5, 6 and 7) the steel post shore has nearly the same elements as shown in FIGS. 1 and 2 . In this embodiment use is made of a different pin construction 35 (FIG. 8). The pin 35 of FIG. 8 has a mainly cylindrical portion 37, at the ends whereof more or less oval cams 39 and 41 are provided. Thus in this embodiment also use is made of a pin with oval portions. In the loaded position of FIG. 4 the pin 35 rests on the ring 12 with its cams 39 and 41 and the tube 3 rests on the upper surface of the pin as indicated by 45 and 46.

In a mounted position (FIG. 4) the pin has to take up a somewhat 15 rotated position according to FIG. 6 and measures must be provided to ensure that the pin remains in that position. This can be achieved in many ways. In this embodiment such is achieved by a local protusion 53 which is present over a small part of the length of the oval portion 39, which rests on the ring 12 and prevents a rotation of the pin in a too early stage.

For quickly releasing the steel post shore, a stroke with a hammer is exerted on the pin 35 in a direction of arrow A, whereby the pin is disengaged and carries out a rotation due to the weight of the loaded inner tube and takes up the position according to FIGS. 5 and 7.

For all embodiments may serve that, after mounting the steel post shore, it is clearly visible wether the relative pen takes up the desired "load" position or not.

What is claimed is:

1. Steel post shore, or prop, for supporting of formwork, deckings or the like in constructing buildings, which has two telescopically movable tubes (1, 3), in which the outer tube (1)—at the end of which the inner tube (3) is inserted—is provided with a threaded portion and in which holes (17) are arranged in a longitudinal row along the inner tube, in which a pin (15) in a direction, transverse to the longitudinal direction of the tube can be passed and can be moved therein in its longitudinal direction, which pin (15) can be supported on a socket or ring (12) being screwed onto the outer side of the outer tube, the pin at its circumference, being provided with recesses such that at its displacement in a longitudinal direction the supported inner tube can be inserted a greater distance into the outer tube, characterised, in that after the displacement of the pin (15, 37) from the fully loaded position of the prop to a nearly unloaded position of said prop, this pin (15, 37) takes up a position, in which in relation to the horizontal it is arranged obliquely, or a position in which it is fallen over around its longitudinal axis.

2. Steel post shore, or prop, according to claim 1, characterised, in that the pin (15) at its upwardly directed, preferably cylindrical surface has a preferably curved recess (27) into which during the horizontal displacement of the pin the inner tube (3) can drop, this pin (15) at its lower end directed to the socket or ring (12) furthermore having a flattened portion (29) at a distance from said recess (29) larger than the diameter of the inner tube, which flattened portion (29) during the horizontal displacement of the pin to its oblique position can be lowered on the ring (12), 3. Steel post shore, or prop, according to claim 1, characterised, in that the pin (15) at its upwardly directed preferably cylindrical surface has a preferably curved recess (27) into which during the horizontal displacement of the pin the inner tube (3) can drop, this pin (15) furthermore having at its lower end directed to the socket or ring (12) a beveled portion (55) at a distance from said recess (23) larger than the wall thickness of the inner tube, which beveled portion (29) after the horizontal displacement of the pin rests in its oblique position on the inner tube (3).

4. Steel post shore, or prop, according to claim 1, characterised, in that the pin (35) has a preferably cylindrical shape, having at both ends cams (39, 41) extending transversely from the pin, that the holes (17) in the inner tube (3) have a longitudinal, preferably oval shape, the longitudinal axis of which extends into the longitudinal direction of the tube, through which holes the pin (35) can be inserted, in which the pin is provided with a locking member (53) cooperating with the upper side of the ring (12) so that the pin with its cams downwardly directed can support the inner tube and by axially moving the pin said locking member comes free from the ring (12) and the pin falls over 90 degrees around its longitudinal axis, in which the cams (39, 41) with a side-surface thereof bear on the ring and the side-surface (37) of the cylindrical portion of the pin (35) takes up a lowered position and supports the lowered inner tube (3), 5. Steel post shore, or prop, according to the claim 4, characterised, in that the inner tube (3) has a number of preferably oval holes (17) extending in the longitudinal direction of this tube, the longest axis of which extending in the longitudinal direction of the tube (3).

* * * * *